US005593957A

United States Patent [19]

Obara et al.

[11] Patent Number: 5,593,957

[45] Date of Patent: Jan. 14, 1997

[54] SYNTHETIC LUBRICATING OIL CONTAINING AN ESTER AND WORKING FLUID COMPOSITION FOR REFRIGERATING MACHINE CONTAINING SAME

[75] Inventors: Nobutoshi Obara; Nobuhiko Shizuka; Fujio Takahashi, all of Hyogo, Japan

[73] Assignee: NOF Corporation, Tokyo, Japan

[21] Appl. No.: 268,023

[22] Filed: Jun. 29, 1994

[30] Foreign Application Priority Data

Jun. 30, 1993 [JP] Japan ..... 5-188712
Jun. 30, 1993 [JP] Japan ..... 5-188713

[51] Int. Cl.[6] ..... C10M 105/38; C10M 105/42

[52] U.S. Cl. ..... 508/501; 508/503

[58] Field of Search ..... 252/56 R, 56 S, 252/68; 526/320

[56] References Cited

U.S. PATENT DOCUMENTS

| | | | |
|---|---|---|---|
| 3,759,862 | 9/1973 | Fukui et al. | 252/32.7 E |
| 4,292,187 | 9/1981 | Hentschel et al. | 252/56 S |
| 4,851,144 | 7/1989 | McGraw et al. | 252/56 S |
| 5,021,179 | 6/1991 | Zehler et al. | 252/56 S |
| 5,096,606 | 3/1992 | Hagihara et al. | 252/68 |
| 5,185,092 | 2/1993 | Fukuda et al. | 252/56 S |
| 5,374,366 | 12/1994 | Nakahara et al. | 252/56 R |

FOREIGN PATENT DOCUMENTS

| | | |
|---|---|---|
| 485979 | 5/1992 | European Pat. Off. . |
| 12849 | 11/1990 | WIPO . |
| 24585 | 12/1993 | WIPO . |
| 25629 | 12/1993 | WIPO . |

*Primary Examiner*—Jacqueline V. Howard
*Attorney, Agent, or Firm*—Henderson & Sturm

[57] ABSTRACT

A synthetic lubricating oil comprises an ester derived from (a) a monohydric alcohol having 4 to 18 carbon atoms which has a branched alcohol content of not less than 50 mol % and/or a neopentylpolyol having not more than 30 carbon atoms, (b) a hydroxycarboxylic acid condensate having an average degree of polymerization of not less than 1.2, and (c) a monocarboxylic acid having 4 to 18 carbon atoms which has a branched carboxylic acid content of not less than 50 mol %.

13 Claims, No Drawings

SYNTHETIC LUBRICATING OIL CONTAINING AN ESTER AND WORKING FLUID COMPOSITION FOR REFRIGERATING MACHINE CONTAINING SAME

FIELD OF THE INVENTION

The present invention relates to a synthetic lubricating oil, particularly a synthetic lubricating oil for use as a refrigerating machine oil in refrigerating machines employing a chlorine-free hydrofluorocarbon as the refrigerant. The invention further relates to a working fluid composition for refrigerating machines which comprises the lubricating oil and a chlorine-free hydrofluorocarbon.

BACKGROUND OF THE INVENTION

Compression-type refrigerating machines have conventionally employed chlorofluorocarbon refrigerants such as CFC-11 ($CCl_3F$, trichloromonofluoromethane), CFC-12 ($CCl_2F_2$, dichlorodifluoromethane), HCFC-22 ($CHClF_2$, monochlorodifluoromethane), and CFC-115 ($CF_3CClF_2$, monochloropentafluoroethane). However, the use of chlorofluorocarbons including CFC-12 has been restricted since they cause ozone layer depletion. Although HCFC-22 has not been restricted in its use so far because of its less ability to deplete the ozone layer, the use thereof will be restricted in the future.

As substitutes for these chlorofluorocarbons, chlorine-free hydrofluorocarbons are coming to be used. Proposed as a substitute for CFC-12 is HFC-134a ($CH_2FCF_3$, 1,1,1,2-tetrafluoroethane), which is similar in thermodynamic properties to CFC-12. Proposed as a substitute for HCFC-22 is a mixed refrigerant which contains HFC-32 ($CH_2F_2$, difluoromethane) and is similar in thermodynamic properties to HCFC-22.

A refrigerating machine oil is required to have various performances, of which the compatibility with a refrigerant is extremely important from the standpoints of the lubricity of the oil and the efficiency of the system. It is, however, known that chlorine-free hydrofluorocarbon refrigerants represented by HFC-134a and HFC-32 are almost incompatible with the refrigerating machine oils conventionally used in compression-type refrigerating systems, which oils contain a naphthene-based mineral oil, paraffin-based mineral oil, alkylbenzene, or the like as the base oil, and that the working fluids containing such chlorine-free hydrofluorocarbon refrigerants undergo two-phase separation both in a low-temperature side and in a high-temperature side.

If the two-phase separation occurs, the lubricating oil is retained in the condenser and expansion device, resulting in a decrease of the efficiency of refrigeration and in insufficient supply of the lubricating oil to the slide way in the compressor. Since the defective lubrication causes troubles including seizure of the compressor, the refrigerating machine cannot be applicable to practical use.

Under these circumstances, various lubricating oils compatible with chlorine-free hydrofluorocarbon refrigerants have been proposed. For example, U.S. Pat. No. 4,755,316 proposes a lubricating oil based on a polyoxyalkylene glycol having a specific molecular weight distribution and terminated by a hydroxyl group at both ends. Although this lubricating oil is compatible with HFC-134a in the temperature range of from about −40° C. to +50° C., the compatibility at higher temperatures is necessary for practical use.

On the other hand, HFC-134a is used mainly in home refrigerators and automotive air-conditioners, and mixed refrigerants containing HFC-32 are goint to be used mainly in home air-conditioners and industrial refrigerating machines. Home refrigerators and home air-conditioners are mostly of the type in which the motor for driving the compressor is used in a refrigerant-refrigerating machine oil mixture and, hence, the refrigerating machine oil is required to have excellent electric insulating property. However, the polyoxyalkylene glycol has much poorer electric insulating property than the conventional naphthene-based mineral oil and paraffin-based mineral oil and also has high hygroscopicity. Consequently, the polyoxyalkylene glycol is unsuitable for use as a refrigerating machine oil for home refrigerators or home air-conditioners.

In WO 90-12849, a polyol ester obtained from a monocarboxylic acid and a polyhydric alcohol and a complex ester obtained from a monocarboxylic acid, a polycarboxylic acid, and a polyhydric alcohol are proposed as lubricating oils for use with a chlorine-free hydrofluorocarbon refrigerant.

Further, as other lubricating oils for use with a chlorine-free hydrofluorocarbon refrigerant, a polyol ester and a complex ester each derived from a condensate of a monohydroxycarboxylic acid with a dihydric neopentyl polyol and from a mono- or dicarboxylic acid are proposed in the 41st Kōbunshi Tōron-kai (September, 1992; sponsored by the Society of Polymer Science, Japan; Polymer Preprints, Japan, Vol.41, No.11, pp. 4703–4705).

These proposed esters have lower hygroscopicity than the polyoxyalkylene glycol and are well compatible with HFC-134a in a wider temperature range than the polyoxyalkylene glycol. The esters also have good electric insulating property, with their volume resistivities being about $10^{13}$ to $10^{14}$ Ωcm at 80° C., as described in EP 406,479-A1; such resistivity values suffice for refrigerating machine oils for use in refrigerators, home air-conditioners, or the like.

Refrigerating machine oils are also required to be supplied in various viscosity grades according to the kinds of refrigerating machines, etc., and the oils currently in use are mostly of ISO viscosity grades VG8 to VG320. The complex esters can provide esters which have good electric insulating property and are of various viscosity grades.

However, since the above-described esters proposed in the art are subject to hydrolysis in the presence of water, there is a fear of corroding the refrigerating system. The polyol esters can inhibit hydrolysis to a practically acceptable level by employing a branched fatty acid as the monocarboxylic acid as one of the starting materials. Although being satisfactory in lubricity and in compatibility with HGC-134a, the complex esters are inferior in hydrolytic stability to the polyol esters. The poor hydrolytic stability of the complex esters may be attributable to the fact that most of the commercially available polycarboxylic acids are linear; the bonded units derived from a linear polycarboxylic acid are liable to hydrolyze.

The polyol esters and complex esters proposed so far are also defective in that the compatibility thereof with a mixed refrigerant containing HFC-32 is still insufficient, although they are compatible with HFC-134a almost satisfactorily.

Furthermore, the esters proposed in the 41st Kōbunshi Tōron-kai, for which a monohydroxycarboxylic acid was used as one of the starting materials, have the following drawbacks. The proposed compounds have a molecular structure comprising units of the ester of a dihydric alcohol with the monohydroxycarboxylic acid and, in order to obtain a high-viscosity ester, these units are bridged with a dicarboxylic acid to give a complex ester. As a result, such high-viscosity esters have poor hydrolytic stability like other complex esters. When the bridging with a dicarboxylic acid is absent, it is difficult to obtain a high-viscosity ester having good compatibility with chlorine-free hydrofluorocarbon refrigerants.

SUMMARY OF THE INVENTION

Accordingly, an object of the present invention is to provide a synthetic lubricating oil which has excellent compatibility with chlorine-free hydrofluorocarbon refrigerants represented by HFC-134a, HFC-32 and HFC-125 (1,1,1,2,2-pentafluoroethane) in a wide temperature range, and which is excellent in electric insulating property and hydrolytic stability and can be supplied in a wide range of viscosity grades.

As a result of intensive studies made by the present inventors in order to attain the above object, it has been found that all of the above-described performances which are required for a refrigerating machine oil for use with a chlorine-free hydrofluorocarbon refrigerant, can be satisfied by using an ester synthesized from specific starting materials, as a lubricating base oil. The present invention has thus been completed.

The present invention provides a synthetic lubricating oil comprising an ester derived from (a) a monohydric alcohol having 4 to 18 carbon atoms which has a branched alcohol content of not less than 50 mol % and/or a neopentyl polyol having not more than 30 carbon atoms, (b) a hydroxycarboxylic acid condensate having an average degree of polymerization of not less than 1.2, and (c) a monocarboxylic acid having 4 to 18 carbon atoms which has a branched carboxylic acid content of not less than 50 mol %.

DETAILED DESCRIPTION OF THE INVENTION

As ingredient (a) for use in the present invention, the monohydric alcohol and/or the neopentyl polyol may be used alone or as a mixture and, when used as a mixture, any desired mixing ratio may be selected.

The monohydric alcohol of ingredient (a) has 4 to 18 carbon atoms. The number of carbon atoms thereof is preferably 4 to 13, more preferably 4 to 10. Monohydric alcohols having not more than 3 carbon atoms adversely affect hydrolytic stability, while the use of monohydric alcohols having not less than 19 carbon atoms results in a decrease in compatibility with chlorine-free hydrofluorocarbon refrigerants.

This monohydric alcohol includes a linear monohydric alcohol and a branched monohydric alcohol, but it is necessary that the branched monohydric alcohol account for not less than 50 mol % of all the monohydric alcohol ingredient. The branched monohydric alcohol content thereof is preferably not less than 70 mol %, more preferably not less than 80 mol %, and most preferably not less than 90 mol %. If the branched monohydric alcohol content is less than 50 mol %, satisfactory results are not obtained with respect to hydrolytic stability and compatibility with chlorine-free hydrofluorocarbon refrigerants.

Examples of the linear monohydric alcohol include 1-butanol, 1-pentanol, 1-hexanol, 1-heptanol, 1-octanol, 1-nonanol, 1-decanol, 1-dodecanol, 1-tridecanol, 1-tetradecanol, 1-hexadecanol, and 1-octadecanol.

Examples of the branched alcohol include 2-methyl-1-propanol, 2-methyl-2-propanol, 2-methyl-1-butanol, 2-ethyl-1-propanol, 2-methyl-1-pentanol, 2,2-dimethyl-1-butanol, 2-methyl-2-ethyl-1-propanol, 2-methyl-1-hexanol, 2,2-dimethyl-1-pentanol, 2-methyl-2-ethyl-1-butanol, 1-isoheptanol, 2-ethyl-1-hexanol, 2,2-dimethyl-1-hexanol, 2-methyl-2-ethyl-1-pentanol, 1-isooctanol, 3,5,5-trimethyl-1-hexanol, 1-isononanol, 1-isodecanol, isododecanol, isotridecanol, isotetradecanol, isohexadecanol, and isooctadecanol.

From the standpoints of the thermal stability and oxidation stability, the monohydric alcohol preferably has a primary hydroxyl group, and more preferably has the carbon atom at the 2-position in relation to the hydroxyl group which carbon atom does not have a hydrogen atom bonded thereto. It is also desirable for obtaining good hydrolytic stability that the monohydric alcohol have a side chain bonded to the carbon atom at the 2-position in relation to the hydroxyl group. Further, from the standpoint of the compatibility with chlorine-free hydrofluorocarbon refrigerants, it is preferred that the alkyl group of the alcohol has a methyl group or an ethyl group as a side chain. Consequently, a branched alcohol having two methyl or ethyl groups bonded to the carbon atom at the 2-position in relation to the hydroxyl group is especially superior to other monohydric alcohols in the thermal stability, the oxidation stability, the hydrolytic stability, and the compatibility with chlorine-free hydrofluorocarbon refrigerants.

Examples of the neopentyl polyol of ingredient (a) for use in the present invention include neopentyl glycol, 2,2-diethyl-1,3-propanediol, 2-butyl-2-ethyl-1,3-propanediol, trimethylolethane, trimethylolpropane, trimethylolbutane, and pentaerythritol. Other examples thereof further include dehydrated neopentyl polyol condensates represented by ditrimethylolpropane, tritrimethylolpropane, dipentaerythritol, and tripentaerythritol. The degree of condensation of such a dehydrated condensate can be determined according to the viscosity required for the synthesized ester.

The neopentyl polyol of ingredient (a) has not more than 30 carbon atoms. The number of carbon atoms thereof is preferably 5 to 24, more preferably 5 to 18. Use of a neopentyl polyol having more than 30 carbon atoms results in a decrease in the compatibility with chlorine-free hydrofluorocarbon refrigerants. Although neopentyl polyols having two or more hydroxyl groups are usable, ones having three or more hydroxyl groups are preferred from the standpoint of lubricity.

The hydroxycarboxylic acid condensate of ingredient (b) for use in the present invention have an average degree of polymerization of not less than 1.2, preferably 1.5 to 20, more preferably 2.0 to 15. If the degree of polymerization thereof is less than 1.2, insufficient lubricity results.

Examples of the hydroxycarboxylic acid which constitutes the hydroxycarboxylic acid condensate include 4-hydroxybutanoic acid, 4-hydroxy-2-methylbutanoic acid, 5-hydroxypentanoic acid, hydroxypivalic acid, 2,2-dimethylolpropionic acid, and 2-hydroxyisobutanoic acid. Also usable are lactones and lactides which both are dehydrated condensates of the above-enumerated hydroxycarboxylic acids.

From the standpoints of the thermal stability and oxidation stability, the hydroxycarboxylic acid preferably has a primary hydroxyl group, and more preferably has the carbon atom at the 2-position in relation to the hydroxyl group which carbon atom does not have a hydrogen atom bonded thereto. From the standpoint of the hydrolytic stability, the hydroxycarboxylic acid preferably has an alkyl group, and more preferably has the 2-position carbon atom, i.e., the carbon atom adjacent to the carboxyl carbon, has one or more alkyl groups. Further, from the standpoint of compatibility with chlorine-free hydrofluorocarbon refrigerants, it is especially preferred that the alkyl group(s) of the hydroxycarboxylic acid be methyl or ethyl.

Examples of such hydroxycarboxylic acids include those represented by formula (1):

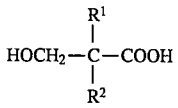

(1)

wherein $R^1$ and $R^2$ each represents a hydrogen atom, a hydroxyl group, a $—CH_2OH$ group, or an alkyl group, provided that when one of $R^1$ and $R^2$ is a hydrogen atom the other is not a hydrogen atom. Preferably $R^1$ and $R^2$ each is a methyl group, an ethyl group, a hydroxyl group, and a $—CH_2OH$ group. The most suitable are hydroxycarboxylic acids having a neopentyl skeleton, with which good results are obtained in regard to the thermal stability, the oxidation stability, the hydrolytic stability, and the compatibility with chlorine-free hydrofluorocarbon refrigerants. From the standpoints of the lubricity and low temperature fluidity, it is desirable that a dihydroxycarboxylic acid be contained in an amount of 10 mol % or more, especially 20 mol % or more.

Further, from the standpoint of the hydrolytic stability, the hydroxycarboxylic acid preferably has one or more side chains bonded to the 2-position carbon atom, i.e., the carbon atom adjacent to the hydroxyl group.

Examples of such a hydroxycarboxylic acid include those represented by formula (2):

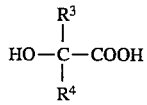

(2)

wherein $R^3$ and $R^4$ each represents a hydrogen atom, a hydroxyl group, or an alkyl group, provided that when one of $R^3$ and $R^4$ is a hydrogen atom, the other is not a hydrogen atom. Most preferably $R^3$ and $R^4$ each is methyl, ethyl, and hydroxyl, with which good results are obtained in regard to the hydrolytic stability. Specific examples thereof include 2-hydroxybutanoic acid, 2-hydroxyisobutanoic acid and 2-hydroxypentanoic acid.

In the present invention the hydroxycarboxylic acid condensate of ingredient (b) can be used in any desired proportion as long as the performances of the ester to be yielded are not adversely affected. In general, however, the adequate amount of ingredient (b) to be used is about 0.2 to 20 mol per mol of the monohydric alcohol or neopentyl polyol of ingredient (a).

The monocarboxylic acid of ingredient (c) for use in the present invention have 4 to 18 carbon atoms. The number of carbon atoms thereof is preferably 4 to 13, more preferably 4 to 10. The use of a monocarboxylic acid having not more than 3 carbon atoms produces an adverse influence on the hydrolytic stability and enhances corrosiveness, whereas the use of a monocarboxylic acid having not less than 19 carbon atoms results in a decrease in the compatibility with chlorine-free hydrofluorocarbon refrigerants.

The monocarboxylic acid of ingredient (c) includes a linear monocarboxylic acid and a branched monocarboxylic acid, but it is necessary that the branched monocarboxylic acid account for not less than 50 mol % of all the monocarboxylic acid ingredient. The branched monocarboxylic acid content thereof is preferably not less than 70 mol %, more preferably not less than 80 mol %, and most preferably not less than 90 mol %. If the branched monocarboxylic acid content is less than 50 mol %, satisfactory results are not obtained with respect to the hydrolytic stability and the compatibility with chlorine-free hydrofluorocarbon refrigerants.

Examples of the linear monocarboxylic acid include butanoic acid, pentanoic acid, hexanoic acid, heptanoic acid, octanoic acid, nonanoic acid, decanoic acid, undecanoic acid, lauric acid, tridecanoic acid, myristic acid, palmitic acid, stearic acid, and the anhydrides of these acids.

Examples of the branched monocarboxylic acid include 2-methylpropanoic acid, 2-methylbutanoic acid, 3-methylbutanoic acid, 2,2-dimethylpropanoic acid, 2-methylpentanoic acid, 3-methylpentanoic acid, 4-methylpentanoic acid, 2,2-dimethylbutanoic acid, 2-ethylbutanoic acid, 3,3-dimethylbutanoic acid, 2,2-dimethylpentanoic acid, 2-methyl-2-ethylbutanoic acid, 2,2,3-trimethylbutanoic acid, 2-ethylpentanoic acid, 3-ethylpentanoic acid, 2-methylhexanoic acid, 3-methylhexanoic acid, 4-methylhexanoic acid, 5-methylhexanoic acid, isoheptanoic acid, 2-ethylhexanoic acid, 3,5-dimethylhexanoic acid, 2,2-dimethylhexanoic acid, 2-methylheptanoic acid, 3-methylheptanoic acid, 4-methylheptanoic acid, 2-propylpentanoic acid, isooctanoic acid, 2,2-dimethylheptanoic acid, 3,5,5-trimethylhexanoic acid, 2-methyloctanoic acid, 2-ethylheptanoic acid, 3-methyloctanoic acid, isononanoic acid, neononanoic acid, 2,2-dimethyloctanoic acid, 2-methyl-2-ethylheptanoic acid, 2-methyl-2-propylhexanoic acid, isodecanoic acid, neodecanoic acid, isotridecanoic acid, isomyristic acid, isopalmitic acid, isostearic acid, and the anhydrides of these acids.

Preferred branched monocarboxylic acids are those having an alkyl branch bonded to the 2-position carbon atom, i.e., the carbon atom adjacent to the carboxyl group. From the standpoint of the compatibility with chlorine-free hydrofluorocarbon refrigerants, it is preferred that the alkyl branch of the carboxylic acid is a methyl group or an ethyl group.

The amount of the above-described monocarboxylic acid of ingredient (c) for use in the present invention may be suitably determined according to the kinds of the monohydric alcohol or neopentyl polyol, ingredient (a), and of the hydroxycarboxylic acid condensate, ingredient (b), etc., as long as the performances of the ester to be yielded are not adversely affected.

The ester for use in the present invention is prepared by reacting the above-described ingredients (a) to (c) in an ordinary way. This ester may be used as a lubricating oil to be used with a chlorine-free hydrofluorocarbon refrigerant, either alone or as a mixture with other lubricating oil. Examples of other lubricating oil include naphthene-based mineral oils, paraffin-based mineral oils, poly(α-olefin)s, alkylbenzenes, esters other than that for use in the present invention, polyoxyalkylene glycols, and fluorinated oils represented by fluorinated polyethers.

When the ester for use in the present invention is mixed with such other lubricating oil the proportion of the ester in the mixture is not particularly limited as long as performances including the hydrolytic stability and the compatibility with chlorine-free hydrofluorocarbon refrigerants are not adversely affected. In general, however, the adequate proportion thereof is not less than 10% by weight, preferably not less than 30% by weight, more preferably not less 50% by weight.

The synthetic lubricating oil of the present invention has a kinematic viscosity at 100° C. of 1 to 150 cSt ($10^{-6}$ $m^2/s$), preferably 1.5 to 100 cSt, more preferably 2 to 50 cSt. Kinematic viscosities below 1 cSt are undesirable because insufficient lubricity results. Kinematic viscosities of more than 150 cSt are also undesirable because the compatibility with chlorine-free hydrofluorocarbon refrigerants is impaired.

In the working fluid composition for refrigerating machines according to the present invention, the weight ratio of the synthetic lubricating oil of the present invention to a chlorine-free hydrofluorocarbon refrigerant is generally from 1:99 to 99:1, preferably from 5:95 to 70:30.

Examples of the chlorine-free hydrofluorocarbon for use in the working fluid composition of the present invention include HFC-134a, HFC-32, and HFC-125. Any one of such chlorine-free hydrofluorocarbons or a mixture of two or more thereof may be suitably selected according to applications, a cooling temperature, the shape of a cooling device, etc.

For further improving the performances of the synthetic lubricating oil of the present invention, conventionally known additives for refrigerating machine oils may be added thereto alone or in combination of two or more thereof if necessary. Examples of such additives include an oxidation inhibitor, an extreme-pressure agent, and a metal deactivator. The amount of such additives to be incorporated is usually not more than 10% by weight, preferably not more than 5% by weight, based on the total amount of the refrigerating machine oil.

The synthetic lubricating oil of the present invention is excellent in the electric insulating property and the hydrolytic stability and can have any of various viscosities in a wide range. Furthermore, the working fluid composition of the present invention for refrigerating machines, which comprises the synthetic lubricating oil of the present invention and any of chlorine-free hydrofluorocarbons represented by HFC-134a, HFC-32, and HFC-125, shows good compatibility over a wide temperature range.

The present invention will be illustrated below in more detail by reference to Examples.

EXAMPLE A-1

(1) Preparation of Hydroxycarboxylic Acid Condensate

In a 1-liter four-necked flask equipped with a stirrer, nitrogen feed pipe, thermometer, and water separator with a condenser were placed 236.3 g (2 mol) of hydroxypivalic acid, 536.6 g (4 mols) of dimethylolpropionic acid, and 3.4 g (0.018 mol) of p-toluenesulfonic acid monohydrate as an esterification catalyst. The mixture was allowed to react at 120° to 150° C. while nitrogen was being fed into the flask at a rate of 300 $cm^3$/min and the acid value was measured at adequate intervals. When the acid value of the reaction product reached 305 mgKOH/g, the flask was cooled to terminate the reaction. The amount of the produced water collected in the water separator was 36 ml, and the average degree of polymerization of the hydroxycarboxylic acid condensate prepared was 1.5 as calculated from the acid value.

(2) Preparation of Ester

In a 2-liter four-necked flask equipped with a stirrer, nitrogen feed pipe, thermometer, and water separator with a condenser were placed 52.9 g (0.6 mol) of 2-methyl-1-butanol, 280.8 g (2.4 mol) of isoheptanol, 551.9 g (3 mol) of the hydroxycarboxylic acid condensate obtained in (1) above and having an average degree of polymerization of 1.5, 245 g (2.4 mol) of 2-methylbutanoic acid, 468.7 g (3.6 mol) of isoheptanoic acid, and 6.02 g (0.032 mol) of p-toluenesulfonic acid monohydrate as an esterification catalyst. The mixture was allowed to react at 200° C. for 22 hours while nitrogen was being fed into the flask at a rate of 300 $cm^3$/min and the distillate water was being removed.

In the above esterification reaction, the molar ratio of ingredient (a) (a monohydric alcohol mixture consisting of 2-methyl-1-butanol and isoheptanol), ingredient (b) (hydroxycarboxylic acid condensate) and ingredient (c) (a monocarboxylic acid mixture consisting of 2-methylbutanoic acid and isoheptanoic acid) was 1:1:2. In ingredient (a), the equivalent ratio of 2-methyl-1-butanol to isoheptanol was 20:80. In ingredient (c), the equivalent ratio of 2-methylbutanoic acid to isoheptanoic acid was 40:60.

After completion of the reaction, distillation was conducted at 200° C. for 8 hours under reduced pressure (10 mmHg) in order to remove the unreacted acids and low-boiling substances. The reaction product obtained as a residue after the distillation was neutralized with 10 wt % aqueous potassium hydroxide solution, washed with water, and then dehydrated at 90° C. for 1 hour under reduced pressure (10 mmHg). Thereto was added 20 g of activated clay. The mixture was stirred at 70° C. for 1 hour and then filtered to prepare an ester having an acid value of 0.04 mgKOH/g. Table 1 summarizes the composition of each of ingredients (a), (b), and (c), the molar ratio of ingredients (a)/(b)/(c), and the acid value of the ester prepared.

Hydroxycarboxylic acid condensates having the average degrees of polymerization shown in Table 1 were prepared in the same manner as in Example A-1 except that the molar ratio of hydroxypivalic acid to dimethylolpropionic acid was changed as shown in the table. By using ingredient (b) consisting of each of the above condensates, ingredients (a) consisting of the monohydric alcohols shown in the table, and the ingredients (c) consisting of the monocarboxylic acids shown in the table in the molar ratio shown in the table, the esters shown in Table 1 were prepared in the same manner as in Example A-1.

EXAMPLES A-2 TO A-38

Hydroxycarboxylic acid condensates having the average degrees of polymerization shown in Tables 1, 2, 3, 4 and 5 were prepared in the same manner as in Example A-1 except that hydroxypivalic acid, dimethylolpropionic acid and 2-hydroxyisobutanoic acid were used as shown in the tables. By using ingredients (b) consisting of the above condensates, ingredients (a) consisting of the monohydric alcohols or neopentyl polyols shown in Tables 1, 2, 3, 4 and 5 and ingredients (c) consisting of the monocarboxylic acids shown in Tables 1, 2, 3, 4 and 5 in the molar ratio shown in the tables, the esters shown in Tables 1, 2, 3, 4 and 5 were prepared in the same manner as in Example A-1.

Comparative Examples B-1 to B-3

Hydroxycarboxylic acid condensates having the average degrees of polymerization shown in Table 6 were prepared in the same manner as in Example A-1 except that the molar ratio of hydroxypivalic acid to dimethylolpropionic acid was changed as shown in the table. By using ingredients (b) consisting of the above condensates, ingredients (a) consisting of the monohydric alcohols shown in the table, and the ingredients (c) consisting of the monocarboxylic acids shown in the table in the molar ratio shown in the table, the esters shown in Table 6 were prepared in the same manner as in Example A-1. Of the esters obtained in Comparative Examples B-1 to B-3, the esters obtained in Comparative Examples B-1 and B-3 are outside the scope of the present invention with respect to the number of carbon atoms of the monohydric alcohols of ingredient (a) and the number of carbon atoms of the monocarboxylic acids of ingredient (c), and the ester prepared in Comparative Example B-2 is outside the scope of the present invention with respect to the proportion of the branched alcohol in the monohydric alcohol of ingredient (a) and the proportion of the branched carboxylic acid in the monocarboxylic acid of ingredient (c).

Comparative Example B-4

In a 2-liter four-necked flask equipped with a stirrer, nitrogen feed pipe, thermometer, and water separator with a condenser were placed 512.8 g (4 mol) of 2-ethyl-1-hexanol, 472.5 g (4 mol) of hydroxypivalic acid, 520.8 g (4 mol) of isoheptanoic acid, and 4.56 g (0.024 mol) of p-toluenesulfonic acid monohydrate as an esterification catalyst. The mixture was allowed to react at 200° C. for 22 hours while nitrogen was being fed into the flask at a rate of 300 $cm^3$/min and the water evaporated was kept being removed.

In this esterification reaction, the molar ratio of 2-ethyl-1-hexanol (monohydric alcohol), hydroxypivalic acid (hydroxycarboxylic acid) and isoheptanoic acid (monocarboxylic acid) was 1:1:1.

Subsequent treatments were conducted in the same manner as in Example A-1 to thereby prepare an ester shown in Table 6.

Comparative Example B-5

In a 2-liter four-necked flask equipped with a stirrer, nitrogen feed pipe, thermometer, and water separator with a condenser were placed 416.6 g (4 mol) of neopentyl glycol, 576.8 g (4 mol) of 2-ethylhexanoic acid, 631.2 g (4 mol) of 3,5,5-trimethylhexanoic acid, and 4.56 g (0.024 mol) of p-toluenesulfonic acid monohydrate as an esterification catalyst. The mixture was allowed to react at 200° C. for 15 hours while nitrogen was being fed into the flask at a rate of 300 $cm^3$/min and the water evaporated was being removed.

In this esterification reaction, the molar ratio of neopentyl glycol to a monocarboxylic acid mixture consisting of 2-ethylhexanoic acid and 3,5,5-trimethylhexanoic acid, was 1:2. The equivalent ratio of 2-ethylhexanoic acid to 3,5,5-trimethylhexanoic acid was 50:50.

Subsequent treatments were conducted in the same manner as in Example A-1 to thereby prepare an ester shown in Table 6.

Comparative Examples B-6 to B-9

The same procedures as in Comparative Example B-5 were conducted except that the neopentyl polyol and the monocarboxylic acids were changed in the kind and the composition as shown in Table 6. The esters thus prepared are shown in the table.

Comparative Example B-10

In a 2-liter four-necked flask equipped with a stirrer, nitrogen feed pipe, thermometer, and water separator with a condenser were placed 429.4 g (3.2 mol) of trimethylolpropane, 415.4 g (2.88 mol) of 2-ethylhexanoic acid, 454.4 g (2.88 mol) of 3,5,5-trimethylhexanoic acid, 280.6 g (1.92 mol) of adipic acid, and 5.7 g (0.03 mol) of p-toluenesulfonic acid monohydrate as an esterification catalyst. The mixture was allowed to react at 200° C. for 15 hours while nitrogen was being fed into the flask at a rate of 300 $cm^3$/min and the water evaporated was being removed.

In this esterification reaction, the molar ratio of trimethylolpropane, a monocarboxylic acid mixture consisting of 2-ethylhexanoic acid and 3,5,5-trimethylhexanoic acid, and adipic acid was 5:9:3. The equivalent ratio of 2-ethylhexanoic acid, 3,5,5-trimethylhexanoic acid and adipic acid was 30:30:40.

Subsequent treatments were conducted in the same manner as in Example A-1 to thereby prepare a complex ester shown in Table 7. In Table 7, polycarboxylic acids are indicated by ingredient (d).

Comparative Examples B-11 and B-12

The same procedures as in Comparative Example B-10 were conducted except that the neopentyl polyol, the kind and composition of the monocarboxylic acids, and the polycarboxylic acid were changed as shown in Table 7. Thus, the complex esters were prepared.

Comparative Examples B-13 to B-15

Hydroxycarboxylic acid condensates having the average degrees of polymerization shown in Table 7 were prepared in the same manner as in Example A-1 except that the molar ratio of hydroxypivalic acid to dimethylolpropionic acid was changed as shown in the table. By using ingredient (b) consisting of the above condensates, ingredient (a) consisting of the neopentyl polyol shown in the table, and ingredient (c) consisting of the monocarboxylic acids shown in the table in the molar ratio shown in the table, the esters shown in Table 7 were prepared in the same manner as in Example A-1. The esters prepared in Comparative Examples B-13 and B-14 are outside the scope of the present invention with respect to the number of carbon atoms of the monocarboxylic acids of ingredient (c), and the ester prepared in Comparative Example B-15 is outside the scope of the invention with respect to the proportion of the branched carboxylic acid in the monocarboxylic acids of ingredient (c).

Comparative Example B-16

In a 2-liter four-necked flask equipped with a stirrer, nitrogen feed pipe, thermometer, and water separator with a condenser were placed 312.5 g (3 mol) of neopentyl glycol, 354.4 g (3 mol) of hydroxypivalic acid, 390.6 g (3 mol) of isoheptanoic acid, 432.6 g (3 mol) of 2-ethylhexanoic acid, and 5.16 g (0.027 mol) of p-toluenesulfonic acid monohydrate as an esterification catalyst. The mixture was allowed to react at 200° C. for 22 hours, while nitrogen was being fed into the flask at a rate of 300 $cm^3$/min and the water evaporated was being removed.

In this esterification reaction, the molar ratio of neopentyl glycol, hydroxypivalic acid, a monocarboxylic acid mixture consisting of isoheptanoic acid and 2-ethylhexanoic acid, was 1:1:2. The equivalent ratio of isoheptanoic acid to 2-ethylhexanoic acid was 50:50.

Subsequent treatments were conducted in the same manner as in Example A-1 to thereby prepare an ester shown in Table 7.

Comparative Example B-17

In a 2-liter four-necked flask equipped with a stirrer, nitrogen feed pipe, thermometer, and water separator with a condenser were placed 384.6 g (3.8 mol) of neopentyl glycol, 509.7 g (3.8 mol) of dimethylolpropionic acid, 296.4 g (2.3 mol) of isoheptanoic acid, 269.8 g (1.7 mol) of 3,5,5-trimethylhexanoic acid, 124.9 g (0.86 mol) of adipic acid, and 5.42 g (0.028 mol) of p-toluenesulfonic acid monohydrate as an esterification catalyst. The mixture was allowed to react at 200° C. for 22 hours, while nitrogen was being fed into the flask at a rate of 300 $cm^3$/min and the water evaporated was being removed.

In this esterification reaction, the molar ratio of neopentyl glycol, dimethylolpropionic acid, a monocarboxylic acid mixture consisting of isoheptanoic acid and 3,5,5-trimethylhexanoic acid and adipic acid was 10:10:14:3. The equivalent ratio of isoheptanoic acid, 3,5,5-trimethylhexanoic acid and adipic acid was 40:30:30.

Subsequent treatments were conducted in the same manner as in Example A-1 to thereby prepare a complex ester shown in Table 7.

In Tables 1 to 7, the following abbreviations are used for the respective ingredients used in Examples A-1 to A-28 and Comparative Examples B-1 to B-17.

<Monohydric Alcohols of Ingredient (a)>
bC4: 2-methyl-1-propanol
bC5: 2-methyl-1-butanol
bC6: 2-ethyl-1-butanol
bC7: isoheptanol
bC8: 2-ethyl-1-hexanol
bC9: 3,5,5-trimethyl-1-hexanol
bC10: 1-isodecanol
bC13: 1-isotridecanol
bC14: isotetradecanol
bC18: isooctadecanol
bC20: isoeicosanol
nC3: 1-propanol
nC4: 1-butanol
nC7: 1-heptanol
nC8: 1-octanol
<Neopentyl polyols of Ingredient (a)>
NPG: neopentyl glycol
TMP: trimethylolpropane
PE: pentaerythritol
DTMP: ditrimethylolpropane
DPE: dipentaerythritol
TPE: tripentaerythritol
<Starting Materials for Hydroxycarboxylic Acid Condensates of Ingredient (b)>
HC5: 3-hydroxy-2,2-dimethylpropanoic acid
DHC5: 2,2-dimethylolpropanoic acid
2HC4: 2-hydroxyisobutanoic acid
<Monocarboxylic Acids of Ingredient (c)>
bC4: 2-methylpropionic acid
bC5: 2-methylbutanoic acid
bC6: 2-ethylbutanoic acid
bC7: isoheptanoic acid
bC8: 2-ethylhexanoic acid
bC9: 3,5,5-trimethylhexanoic acid
bC10: isodecanoic acid
bC13: isotridecanoic acid
bC14: isomyristic acid
bC18: isostearic acid
bC20: isoarachic acid
nC3: propanoic acid
nC4: butanoic acid
nC6: hexanoic acid
nC8: octanoic acid
<Polycarboxylic Acids>
2C4: succinic acid
2C6: adipic acid
2C10: sebacic acid With respect to the esters prepared in Examples A-1 to A-38 and Comparative Examples B-1 to B-17 given above, performances required for refrigerating machine lubricating oils were examined by the following methods. The results are summarized in Tables 8 to 11.

<General Properties>

Kinematic Viscosity: Kinematic viscosity at 40° C. and 100° C. (JIS K 2283) was measured.

Pour Point: Pour Point (JIS K 2269) was measured.

Electric Insulating Property: Volume resistivity at 80° C. (JIS C 2101) was measured.

<Compatibility>

20 Parts by weight (0.6 g) of a sample and 80 parts by weight (2.4 g) of a chlorine-free hydrofluorocarbon refrigerant (each of HFC-134a and a mixed refrigerant (HFC-32:HFC-125:HFC-134a=23:25:52)) were placed in a thick-wall pyrex tube (whole length, 300 mm; outer diameter, 10 mm; inner diameter, 6 mm) cooled in a methanol bath placed in dry ice. The tube was sealed, and then heated and cooled at a rate of 1° C./min in the range of −70° C. to +80° C. to visually determine two-phase separation temperature both at high temperatures and at low temperatures.

<Hydrolytic Stability>

Into a 6-ml hard glass ampule was poured 5 ml of a sample regulated to have a water content of 1,500±300 ppm. After the head space within the ampule was displaced with nitrogen, the ampule was sealed and then heated at 150° C. for 300 hours. After completion of the test, the ampule was opened and the acid value of the sample was measured.

<Wear Resistance (Lubricity)>

Falex wear test was performed in accordance with ASTM D-2670, while HFC-134a was being blown into the sample at a rate of 150 ml/min. The sample temperature was kept at 100° C. and the tester was first preliminarily run at a load of 150 lb for 1 minute and then run at a load of 250 lb for 2 hours. The wear amount of the pin was measured at the end of the testing.

For reference, the following samples C-1 to C-3 commercially available as refrigerating machine lubricating oils were also tested. The results are also given in Tables 8 and 11.

C-1: polyoxyalkylene glycol
(ISO viscosity grade: VG56)
C-2: mineral oil-based refrigerator oil
(ISO viscosity grade: VG32)
C-3: alkylbenzene-based refrigerator oil
(ISO viscosity grade: VG46)

TABLE 1

| Composition | Example | | | | | | | | |
|---|---|---|---|---|---|---|---|---|---|
| | A-1 | A-2 | A-3 | A-4 | A-5 | A-6 | A-7 | A-8 | A-9 |
| Ingredient (a) (eq. ratio) | | | | | | | | | |
| bC4 | — | — | — | — | — | 15 | — | — | — |
| bC5 | 20 | — | — | — | — | — | — | — | — |
| bC6 | — | — | — | — | 15 | — | — | — | — |
| bC7 | 80 | — | — | 40 | — | 45 | — | — | 10 |
| bC8 | — | — | — | — | — | — | — | 20 | 50 |
| bC9 | — | 100 | 100 | — | — | — | 50 | — | 40 |
| bC10 | — | — | — | — | 85 | — | 50 | — | — |
| bC13 | — | — | — | 40 | — | — | — | 30 | — |
| bC18 | — | — | — | — | — | 40 | — | — | — |
| nC4 | — | — | — | — | — | — | — | 10 | — |
| nC7 | — | — | — | 20 | — | — | — | — | — |
| nC8 | — | — | — | — | — | — | — | 40 | — |
| Ingredient (b) | | | | | | | | | |
| HC5/DHC5 (molar ratio) | 1/2 | 0/1 | 1/0 | 0/1 | 0/1 | 2/3 | 1/0 | 9/3 | 0/1 |
| Average degree of polymerization | 1.5 | 2.0 | 3.0 | 4.0 | 5.0 | 5.0 | 10.0 | 12.0 | 10.0 |
| Ingredient (c) (eq. ratio) | | | | | | | | | |
| bC4 | — | — | — | — | 10 | — | — | — | — |
| bC5 | 40 | — | — | — | — | — | — | — | — |
| bC6 | — | 100 | — | 20 | — | — | — | — | — |
| bC7 | 60 | — | — | — | — | 60 | — | — | 10 |
| bC8 | — | — | — | 60 | 90 | — | — | — | 50 |
| bC9 | — | — | 100 | — | — | — | 100 | — | 40 |
| bC13 | — | — | — | — | — | — | — | — | 30 |
| bC14 | — | — | — | — | — | — | — | — | 20 |
| bC18 | — | — | — | — | — | 40 | — | — | — |
| nC4 | — | — | — | — | — | — | — | — | 10 |
| nC6 | — | — | — | 20 | — | — | — | — | — |
| nC8 | — | — | — | — | — | — | — | — | 40 |
| Ingredients (a)/(b)/(c) | | | | | | | | | |
| (molar ratio) | 1/1/2 | 1/1/3 | 1/1/1 | 1/1/5 | 1/1/6 | 1/1/4 | 1/1/1 | 1/1/4 | 1/1/11 |
| Acid value (mgKOH/g) | 0.04 | 0.02 | 0.05 | 0.05 | 0.06 | 0.06 | 0.03 | 0.04 | 0.02 |

TABLE 2

| Composition | Example | | | | | | | | | |
|---|---|---|---|---|---|---|---|---|---|---|
| | A-10 | A-11 | A-12 | A-13 | A-14 | A-15 | A-16 | A-17 | A-18 | A-19 |
| Ingredient (a) | | | | | | | | | | |
| Neopentyl polyol | NPG | NPG | TMP | TMP | TMP | TMP | PE | PE | PE | DPE |
| Ingredient (b) | | | | | | | | | | |
| HC5/DHC5 (molar ratio) | 2/1 | 1/0 | 0/1 | 2/1 | 1/0 | 1/0 | 0/1 | 1/1 | 2/3 | 0/1 |
| [Average degree of polymerization] | 1.5 | 2.0 | 1.5 | 3.0 | 2.0 | 1.5 | 3.0 | 2.0 | 4.0 | 3.0 |
| Ingredient (c) (eq. ratio) | | | | | | | | | | |
| bC4 | 10 | — | — | — | — | 40 | — | — | — | 10 |
| bC5 | — | — | 70 | — | 50 | — | — | — | — | — |
| bC6 | — | — | — | — | — | — | — | 100 | 50 | — |
| bC7 | — | 10 | 20 | — | — | — | — | — | — | — |
| bC8 | 40 | — | — | 100 | — | 50 | — | — | — | 60 |
| bC9 | 50 | 80 | — | — | — | — | 70 | — | 50 | — |
| bC10 | — | — | — | — | — | 10 | — | — | — | 30 |
| bC14 | — | 10 | — | — | — | — | — | — | — | — |
| bC18 | — | — | 10 | — | — | — | — | — | — | — |
| nC4 | — | — | — | — | — | — | 20 | — | — | — |
| nC6 | — | — | — | — | 50 | — | — | — | — | — |
| nC8 | — | — | — | — | — | — | 10 | — | — | — |
| nC18 | — | — | — | — | — | — | — | — | — | — |
| Ingredients (a)/(b)/(c) | | | | | | | | | | |
| (molar ratio) | 2/2/5 | 1/2/2 | 5/10/33 | 1/1/4 | 1/3/3 | 1/6/4 | 1/1/7 | 1/2/6 | 2/5/20 | 1/3/15 |
| Acid value (mgKOH/g) | 0.05 | 0.02 | 0.05 | 0.03 | 0.06 | 0.04 | 0.05 | 0.06 | 0.03 | 0.07 |

TABLE 3

| Composition | Example A-20 | A-21 | A-22 | A-23 | A-24 | A-25 | A-26 | A-27 | A-28 |
|---|---|---|---|---|---|---|---|---|---|
| Ingredient (a) (eq. ratio) | | | | | | | | | |
| bC5 | — | — | — | 5 | — | — | — | — | 70 |
| bC6 | — | — | — | — | — | 6 | 2 | 30 | — |
| bC7 | — | 8 | — | — | 5 | 38 | — | — | — |
| bC9 | 23 | 15 | 38 | 13 | 16 | — | 18 | 30 | — |
| bC13 | — | 2 | — | 2 | 3 | — | 2 | — | — |
| nC4 | — | — | — | 5 | — | — | — | — | 10 |
| nC6 | — | — | — | — | 3 | 6 | — | — | 6 |
| Neopentyl polyol | NPG | NPG | TMP | TMP | PE | PE | DPE | DTMP | DPE/TPE = 1/1 (molar ratio) mixture |
| | 77 | 75 | 62 | 75 | 73 | 50 | 78 | 40 | 14 |
| Ingredient (b) | | | | | | | | | |
| HC5/DHC5/2HC4 (molar ratio) | 250/838/113 | 8/7/0 | 259/835/106 | 1/2/0 | 1/2/0 | 3/3/10 | 1/2/0 | 0/2/1 | 1/1/1 |
| Average degree of polymerization | 3.0 | 1.9 | 2.1 | 2.0 | 2.7 | 2.7 | 2.1 | 1.5 | 1.5 |
| Ingredient (c) (eq. ratio) | | | | | | | | | |
| bC5 | 90 | 50 | 100 | 87 | 80 | 80 | 85 | 60 | 100 |
| bC6 | — | — | — | 10 | 5 | 10 | — | — | — |
| bC7 | — | — | — | — | 10 | — | 10 | — | — |
| bC8 | — | 22 | — | — | — | — | 5 | 20 | — |
| bC9 | — | 25 | — | — | — | — | — | — | — |
| bC14 | — | 3 | — | — | — | — | — | — | — |
| bC18 | — | — | — | 3 | — | — | — | — | — |
| nC6 | 10 | — | — | — | 5 | 10 | — | 20 | — |
| Ingredients (a)/(b)/(c) (molar ratio) | 32/15/87 | 5/5/13 | 50/149/317 | 25/25/81 | 9/9/35 | 94/94/289 | 104/104/449 | 7/7/17 | 11/11/18 |
| Acid value (mgKOH/g) | 0.02 | 0.05 | 0.07 | 0.06 | 0.05 | 0.03 | 0.04 | 0.04 | 0.07 |

TABLE 4

| Composition | Example A-29 | A-30 | A-31 |
|---|---|---|---|
| Ingredient (a) (eq. ratio) | | | |
| bC4 | — | — | — |
| bC5 | — | — | — |
| bC6 | — | — | — |
| bC7 | — | — | 100 |
| bC8 | — | — | — |
| bC9 | 100 | 50 | — |
| bC10 | — | 50 | — |
| bC13 | — | — | — |
| bC18 | — | — | — |
| nC4 | — | — | — |
| nC7 | — | — | — |
| nC8 | — | — | — |
| Ingredient (b) | | | |
| HC5/DHC5/2HC4 (molar ratio) | 1/2/0 | 1/2/1 | 0/3/1 |
| Average degree of polymerization | 2.5 | 2.0 | 3.0 |

TABLE 4-continued

| Composition | Example A-29 | A-30 | A-31 |
|---|---|---|---|
| Ingredient (c) (eq. ratio) | | | |
| bC4 | — | — | — |
| bC5 | 100 | — | 100 |
| bC6 | — | — | — |
| bC7 | — | — | — |
| bC8 | — | — | — |
| bC9 | — | 100 | — |
| bC13 | — | — | — |
| bC14 | — | — | — |
| bC18 | — | — | — |
| nC4 | — | — | — |
| nC6 | — | — | — |
| nC8 | — | — | — |
| Ingredients (a)/(b)/(c) (molar ratio) | 3/3/8 | 1/1/2 | 10/4/19 |
| Acid value (mgKOH/g) | 0.05 | 0.03 | 0.02 |

TABLE 5

| Composition | Example | | | | | | |
|---|---|---|---|---|---|---|---|
| | A-32 | A-33 | A-34 | A-35 | A-36 | A-37 | A-38 |
| Ingredient (a) Neopentyl polyol | NPG | TMP | TMP | TMP | PE | PE | DPE |
| Ingredient (b) | | | | | | | |
| HC5/DHC5/2HC4 (molar ratio) | 0/1/0 | 22/47/0 | 59/91/0 | 0/3/1 | 1/2/0 | 1/2/0 | 1/2/0 |
| [Average degree of polymerization] | 8.0 | 1.5 | 1.8 | 1.5 | 1.5 | 3.0 | 1.5 |
| Ingredient (c) (eq. ratio) | | | | | | | |
| bC4 | — | — | — | 10 | 40 | 40 | 10 |
| bC5 | — | 94 | 18 | 80 | 20 | 40 | 80 |
| bC6 | — | — | 10 | — | 40 | — | 10 |
| bC7 | — | 4 | — | — | — | 20 | — |
| bC8 | — | — | 40 | — | — | — | — |
| bC9 | 100 | — | — | — | — | — | — |
| bC10 | — | — | 10 | — | — | — | — |
| bC14 | — | — | 2 | — | — | — | — |
| bC18 | — | 2 | — | — | — | — | — |
| nC4 | — | — | — | 10 | — | — | — |
| nC6 | — | — | 20 | — | — | — | — |
| nC8 | — | — | — | — | — | — | — |
| nC18 | — | — | — | — | — | — | — |
| Ingredients (a)/(b)/(c) (molar ratio) | 5/1/18 | 39/40/58 | 19/19/76 | 8/24/51 | 1/1/5 | 1/1/6 | 1/1/7 |
| Acid value (mgKOH/g) | 0.02 | 0.05 | 0.03 | 0.06 | 0.04 | 0.03 | 0.07 |

TABLE 6

| Composition | Comparative Example | | | | | | | | |
|---|---|---|---|---|---|---|---|---|---|
| | B-1 | B-2 | B-3 | B-4 | B-5 | B-6 | B-7 | B-8 | B-9 |
| Ingredient (a) (eq. ratio) | | | | | | | | | |
| bC6 | — | 40 | — | — | — | — | — | — | — |
| bC8 | — | — | — | 100 | — | — | — | — | — |
| bC10 | — | — | 20 | — | — | — | — | — | — |
| bC13 | 70 | — | — | — | — | — | — | — | — |
| bC18 | — | — | 30 | — | — | — | — | — | — |
| bC20 | 30 | — | — | — | — | — | — | — | — |
| nC3 | — | — | 50 | — | — | — | — | — | — |
| nC8 | — | 60 | — | — | — | — | — | — | — |
| Neopentyl polyol | — | — | — | — | NPG | TMP | PE | DPE | DPE |
| | — | — | — | — | 100 | 100 | 100 | 100 | 100 |
| Ingredient (b) | | | | | | | | | |
| HC5/DHC5 (molar ratio) | 1/0 | 0/1 | 1/3 | 1/0 | — | — | — | — | — |
| Average degree of polymerization | 5.0 | 3.0 | 4.0 | 1.0 | — | — | — | — | — |
| Ingredient (c) (eq. ratio) | | | | | | | | | |
| bC6 | — | 40 | — | — | — | — | — | — | — |
| bC7 | — | — | — | 100 | — | — | — | — | — |
| bC8 | — | — | — | — | 50 | — | — | 40 | — |
| bC9 | — | — | — | — | 50 | 100 | — | — | 100 |
| bC10 | 70 | — | 20 | — | — | — | — | — | — |
| bC13 | — | — | — | — | — | — | 30 | — | — |
| bC14 | — | — | — | — | — | — | 40 | 60 | — |
| bC18 | — | — | 30 | — | — | — | 30 | — | — |
| bC20 | 30 | — | — | — | — | — | — | — | — |
| nC3 | — | — | 50 | — | — | — | — | — | — |
| nC8 | — | 60 | — | — | — | — | — | — | — |
| Ingredients (a)/(b)/(c) (molar ratio) | 1/1/1 | 1/1/4 | 1/1/4 | 1/1/1 | 1/0/2 | 1/0/3 | 1/0/4 | 1/0/6 | 1/0/6 |
| Acid value (mgKOH/g) | 0.03 | 0.05 | 0.03 | 0.03 | 0.07 | 0.04 | 0.07 | 0.06 | 0.07 |

TABLE 7

| Composition | Comparative Example | | | | | | | |
|---|---|---|---|---|---|---|---|---|
| | B-10 | B-11 | B-12 | B-13 | B-14 | B-15 | B-16 | B-17 |
| Ingredient (a) Neopentyl polyol | TMP | TMP | NPG | NPG | TMP | PE | NPG | NPG |
| Ingredient (b) | | | | | | | | |
| HC5/DHC5 (molar ratio) | — | — | — | 1/0 | 1/4 | 0/1 | 1/0 | 0/1 |

TABLE 7-continued

| Composition | Comparative Example | | | | | | | |
|---|---|---|---|---|---|---|---|---|
| | B-10 | B-11 | B-12 | B-13 | B-14 | B-15 | B-16 | B-17 |
| Average degree of polymerization | — | — | — | 2.0 | 2.5 | 4.0 | 1.0 | 1.0 |
| Ingredient (c) (eq. ratio) | | | | | | | | |
| bC5 | — | — | — | — | — | 30 | — | — |
| bC6 | — | — | — | 20 | — | — | — | — |
| bC7 | — | 20 | — | 0 | 30 | — | 50 | 40 |
| bC8 | 30 | 50 | 35 | 40 | — | — | 50 | — |
| bC9 | 30 | — | 35 | — | 30 | — | — | 30 |
| bC13 | — | — | — | 20 | — | — | — | — |
| bC20 | — | — | — | 20 | — | — | — | — |
| nC3 | — | — | — | — | 40 | — | — | — |
| nC6 | — | — | — | — | — | 70 | — | — |
| Ingredient (d): Polycarboxylic acid (eq. ratio) | | | | | | | | |
| 2C4 | — | — | 30 | — | — | — | — | — |
| 2C6 | 40 | — | — | — | — | — | — | 30 |
| 2C10 | — | 30 | — | — | — | — | — | — |
| Ingredient (a)/(b)/(c)/(d) (molar ratio) | 5/0/9/3 | 20/0/42/9 | 10/0/14/3 | 1/4/2/0 | 1/2/7/0 | 1/2/12/0 | 1/1/2/0 | 10/10/14/3 |
| Acid value (mgKOH/g) | 0.05 | 0.06 | 0.03 | 0.05 | 0.03 | 0.05 | 0.05 | 0.06 |

TABLE 8

| Example | Kinematic viscosity (cSt) at 40° C. | Kinematic viscosity (cSt) at 100° C. | Pour point °C. | Volume resistivity (Ω · cm) |
|---|---|---|---|---|
| A-1 | 21.7 | 4.09 | −70 | $7.4 \times 10^{13}$ |
| A-2 | 59.7 | 7.15 | −60 | $5.9 \times 10^{13}$ |
| A-3 | 81.0 | 8.60 | −55 | $1.1 \times 10^{14}$ |
| A-4 | 122.1 | 11.6 | −50 | $2.1 \times 10^{14}$ |
| A-5 | 151.8 | 13.4 | −45 | $1.8 \times 10^{14}$ |
| A-6 | 203.2 | 15.8 | −35 | $6.8 \times 10^{13}$ |
| A-7 | 159.7 | 13.6 | −40 | $4.0 \times 10^{13}$ |
| A-8 | 256.8 | 18.9 | −30 | $1.4 \times 10^{14}$ |
| A-9 | 360.3 | 22.6 | −25 | $6.9 \times 10^{13}$ |
| A-10 | 28.3 | 4.75 | −65 | $3.2 \times 10^{14}$ |
| A-11 | 97.8 | 9.88 | −50 | $9.6 \times 10^{13}$ |
| A-12 | 102.3 | 10.2 | −45 | $5.6 \times 10^{13}$ |
| A-13 | 80.5 | 8.62 | −55 | $1.8 \times 10^{14}$ |
| A-14 | 74.6 | 8.76 | −55 | $6.5 \times 10^{13}$ |
| A-15 | 126.1 | 11.8 | −45 | $2.1 \times 10^{14}$ |
| A-16 | 204.9 | 16.1 | −35 | $7.4 \times 10^{13}$ |
| A-17 | 78.0 | 8.60 | −60 | $1.5 \times 10^{14}$ |
| A-18 | 310.9 | 20.9 | −30 | $2.9 \times 10^{14}$ |
| A-19 | 411.7 | 25.3 | −25 | $2.3 \times 10^{14}$ |
| A-20 | 196.8 | 18.1 | −60 | $8.9 \times 10^{13}$ |
| A-21 | 48.3 | 6.97 | −55 | $7.6 \times 10^{13}$ |
| A-22 | 366.9 | 27.3 | −45 | $2.1 \times 10^{14}$ |
| A-23 | 89.7 | 10.8 | −50 | $9.6 \times 10^{13}$ |
| A-24 | 220.6 | 18.9 | −40 | $3.6 \times 10^{14}$ |
| A-25 | 280.5 | 22.6 | −45 | $2.8 \times 10^{14}$ |
| A-26 | 210.2 | 18.8 | −35 | $7.8 \times 10^{13}$ |
| A-27 | 310.6 | 21.3 | −30 | $1.4 \times 10^{14}$ |
| A-28 | 371.2 | 22.1 | −25 | $6.8 \times 10^{13}$ |
| A-29 | 123.4 | 14.0 | −50 | $1.2 \times 10^{14}$ |
| A-30 | 158.6 | 13.5 | −40 | $4.2 \times 10^{13}$ |
| A-31 | 358.3 | 22.4 | −25 | $7.1 \times 10^{13}$ |
| A-32 | 169.9 | 14.9 | −45 | $9.4 \times 10^{13}$ |
| A-33 | 97.5 | 11.0 | −45 | $5.8 \times 10^{13}$ |
| A-34 | 63.3 | 8.17 | −55 | $1.6 \times 10^{14}$ |
| A-35 | 340.0 | 55.5 | −30 | $6.5 \times 10^{13}$ |
| A-36 | 153.8 | 13.4 | −40 | $1.2 \times 10^{14}$ |
| A-37 | 460.4 | 26.8 | −25 | $9.8 \times 10^{13}$ |
| A-38 | 385.1 | 25.3 | −25 | $6.7 \times 10^{13}$ |

TABLE 9

| Example | Kinematic viscosity (cSt) at 40° C. | Kinematic viscosity (cSt) at 100° C. | Pour point °C. | Volume resistivity (Ω · cm) |
|---|---|---|---|---|
| B-1 | 142.3 | 12.7 | −45 | $7.3 \times 10^{13}$ |
| B-2 | 60.2 | 7.42 | −60 | $2.2 \times 10^{14}$ |
| B-3 | 176.2 | 15.2 | −40 | $2.8 \times 10^{14}$ |
| B-4 | 14.3 | 3.18 | −70 | $1.6 \times 10^{14}$ |
| B-5 | 10.4 | 2.62 | −65 | $9.3 \times 10^{13}$ |
| B-6 | 68.1 | 8.02 | −55 | $1.0 \times 10^{14}$ |
| B-7 | 217.1 | 16.2 | −50 | $1.3 \times 10^{14}$ |
| B-8 | 224.2 | 16.6 | −50 | $8.8 \times 10^{13}$ |
| B-9 | 202.1 | 16.3 | −55 | $7.9 \times 10^{13}$ |
| B-10 | 310.5 | 25.5 | −45 | $6.3 \times 10^{13}$ |
| B-11 | 107.5 | 12.8 | −35 | $1.1 \times 10^{14}$ |
| B-12 | 45.5 | 7.15 | −15 | $5.6 \times 10^{13}$ |
| B-13 | 75.3 | 8.23 | −50 | $8.5 \times 10^{13}$ |
| B-14 | 147.8 | 13.1 | −40 | $1.7 \times 10^{14}$ |
| B-15 | 166.2 | 14.2 | −45 | $2.2 \times 10^{14}$ |
| B-16 | 21.4 | 4.05 | −65 | $8.6 \times 10^{13}$ |
| B-17 | 164.1 | 14.6 | −55 | $8.4 \times 10^{13}$ |
| C-1 | 56.0 | 10.9 | −45 | $2.1 \times 10^{7}$ |
| C-2 | 29.8 | 4.2 | −45 | $2.1 \times 10^{15}$ |
| C-3 | 46.0 | 5.92 | −45 | $7.8 \times 10^{14}$ |

TABLE 10

| Example | Compatibility (two-phase separation temperature) (°C.) HFC-134a lower-temperature side | HFC-134a higher-temperature side | Mixed refrigerant lower-temperature side | Mixed refrigerant higher-temperature side | Hydrolytic stability (acid value) (mgKOH/g) before test | after test | Wear resistance, Pin wear amount in Falex test (mg) |
|---|---|---|---|---|---|---|---|
| A-1 | ≦−70 | ≧80 | ≦−45 | ≧80 | 0.04 | 0.31 | 17 |
| A-2 | ≦−70 | ≧80 | −45 | ≧80 | 0.02 | 0.40 | 13 |
| A-3 | −60 | ≧80 | −35 | ≧80 | 0.05 | 0.56 | 15 |
| A-4 | −55 | ≧80 | −30 | ≧80 | 0.05 | 0.95 | 8 |
| A-5 | −50 | ≧80 | −30 | ≧80 | 0.06 | 0.54 | 12 |
| A-6 | −45 | ≧80 | −25 | ≧80 | 0.06 | 0.36 | 11 |
| A-7 | −45 | ≧80 | −25 | ≧80 | 0.03 | 0.46 | 16 |
| A-8 | −35 | ≧80 | −20 | ≧80 | 0.04 | 1.4 | 6 |
| A-9 | −30 | ≧80 | −20 | ≧80 | 0.02 | 0.33 | 7 |
| A-10 | ≦−70 | ≧80 | −50 | ≧80 | 0.05 | 0.40 | 16 |
| A-11 | −60 | ≧80 | −40 | ≧80 | 0.02 | 0.33 | 14 |
| A-12 | −55 | ≧80 | −35 | ≧80 | 0.05 | 0.29 | 17 |
| A-13 | −65 | ≧80 | −40 | ≧80 | 0.03 | 0.29 | 18 |
| A-14 | −45 | ≧80 | −30 | ≧80 | 0.06 | 1.3 | 10 |
| A-15 | −45 | ≧80 | −35 | ≧80 | 0.04 | 0.35 | 19 |
| A-16 | −35 | ≧80 | −25 | ≧80 | 0.05 | 0.89 | 11 |
| A-17 | −65 | ≧80 | −45 | ≧80 | 0.06 | 0.41 | 13 |
| A-18 | −40 | ≧80 | −25 | ≧80 | 0.03 | 0.30 | 9 |
| A-19 | −30 | ≧80 | −20 | ≧80 | 0.07 | 0.42 | 7 |
| A-20 | −65 | ≧80 | −45 | ≧80 | 0.02 | 0.31 | 14 |
| A-21 | ≦−70 | ≧80 | ≦−70 | ≧80 | 0.05 | 0.36 | 18 |
| A-22 | ≦−70 | ≧80 | ≦−70 | ≧80 | 0.07 | 0.33 | 13 |
| A-23 | ≦−70 | ≧80 | ≦−70 | ≧80 | 0.06 | 0.86 | 13 |
| A-24 | ≦−70 | ≧80 | ≦−70 | ≧80 | 0.05 | 0.45 | 8 |
| A-25 | −55 | ≧80 | −35 | ≧80 | 0.03 | 0.48 | 9 |
| A-26 | ≦−70 | ≧80 | ≦−70 | ≧80 | 0.04 | 0.63 | 12 |
| A-27 | −36 | ≧80 | −22 | ≧80 | 0.04 | 0.46 | 7 |
| A-28 | −30 | ≧80 | −22 | ≧80 | 0.07 | 0.37 | 9 |
| A-29 | ≦−70 | ≧80 | −65 | ≧80 | 0.05 | 0.57 | 14 |
| A-30 | −45 | ≧80 | −25 | ≧80 | 0.03 | 0.31 | 16 |
| A-31 | −30 | ≧80 | −20 | ≧80 | 0.02 | 0.32 | 8 |
| A-32 | −60 | ≧80 | −40 | ≧80 | 0.02 | 0.33 | 15 |
| A-33 | −55 | ≧80 | −65 | ≧80 | 0.04 | 0.29 | 17 |
| A-34 | ≦−70 | ≧80 | −65 | ≧80 | 0.03 | 0.60 | 17 |
| A-35 | ≦−70 | ≧80 | −65 | ≧80 | 0.06 | 0.30 | 9 |
| A-36 | ≦−70 | ≧80 | ≦−70 | ≧80 | 0.05 | 0.35 | 19 |
| A-37 | ≦−70 | ≧80 | ≦−70 | ≧80 | 0.03 | 0.29 | 10 |
| A-38 | ≦−70 | ≧80 | ≦−70 | ≧80 | 0.07 | 0.41 | 8 |

TABLE 11

| Example | Compatibility (two-phase separation temperature) (°C.) HFC-134a lower-temperature side | HFC-134a higher-temperature side | Mixed refrigerant lower-temperature side | Mixed refrigerant higher-temperature side | Hydrolytic stability (acid value) (mgKOH/g) before test | after test | Wear resistance, Pin wear amount in Falex test (mg) |
|---|---|---|---|---|---|---|---|
| B-1 | −20 | ≧80 | insoluble | insoluble | 0.03 | 0.46 | 14 |
| B-2 | −55 | ≧80 | −30 | ≧80 | 0.05 | 3.4 | 12 |
| B-3 | −45 | ≧80 | −25 | ≧80 | 0.03 | 3.1 | 9 |
| B-4 | ≦−70 | ≧80 | −45 | ≧80 | 0.03 | 0.35 | 30 |
| B-5 | ≦−70 | ≧80 | −15 | ≧80 | 0.07 | 0.38 | 21 |
| B-6 | −50 | ≧80 | −10 | ≧80 | 0.04 | 0.52 | 12 |
| B-7 | −10 | ≧80 | insoluble | insoluble | 0.07 | 0.13 | 14 |
| B-8 | −15 | ≧80 | insoluble | insoluble | 0.06 | 0.17 | 8 |
| B-9 | −10 | ≧80 | insoluble | insoluble | 0.07 | 0.45 | 10 |
| B-10 | −60 | ≧80 | −20 | ≧80 | 0.05 | 4.9 | 18 |
| B-11 | −65 | ≧80 | −35 | ≧80 | 0.06 | 5.4 | 24 |
| B-12 | ≦−70 | ≧80 | −10 | ≧80 | 0.03 | 5.8 | 28 |
| B-13 | −20 | ≧80 | insoluble | insoluble | 0.05 | 0.18 | 18 |
| B-14 | −40 | ≧80 | −30 | ≧80 | 0.03 | 3.1 | 14 |
| B-15 | −50 | ≧80 | −40 | ≧80 | 0.05 | 4.4 | 11 |
| B-16 | ≦−70 | ≧80 | −40 | ≧80 | 0.05 | 0.37 | 42 |

TABLE 11-continued

| Example | Compatibility (two-phase separation temperature) (°C.) HFC-134a lower-temperature side | HFC-134a higher-temperature side | Mixed refrigerant lower-temperature side | Mixed refrigerant higher-temperature side | Hydrolytic stability (acid value) (mgKOH/g) before test | after test | Wear resistance, Pin wear amount in Falex test (mg) |
|---|---|---|---|---|---|---|---|
| B-17 | −65 | ≧80 | −40 | ≧80 | 0.06 | 4.1 | 10 |
| C-1 | −50 | 52 | insoluble | insoluble | 0.04 | 0.06 | 44 |
| C-2 | insoluble | insoluble | insoluble | insoluble | 0.03 | 0.07 | — |
| C-3 | insoluble | insoluble | insoluble | insoluble | 0.06 | 0.11 | — |

The results in Tables 8 to 11 show that the esters for use in the synthetic lubricating oil of the present invention have a wide range of viscosities, have a pour point of not more than −25° C., are compatible with HFC-134a at not more than −30° C. in a low temperature side and at not less than +80° C. in a high temperature side and with a mixed refrigerant containing HFC-32 not more than −20° C. in a low temperature side and at not less than +80° C. in a high temperature side, have a volume resistivity as high as $10^{13}$ to $10^{14}$ Ωcm, and suffer only slight increases in acid value through the hydrolytic stability test.

As described above, the synthetic lubricating oil of the present invention is excellent in the electric insulating property and the hydrolytic stability. Further, the working fluid composition of the present invention for refrigerating machines, which comprises the synthetic lubricating oil of the present invention and a chlorine-free hydrofluorocarbon refrigerant, shows exceedingly good compatibility in a wide temperature range and in a wide range of viscosities of the synthetic lubricating oil of the present invention and has extremely good properties.

While the invention has been described in detail and with reference to specific embodiments thereof, it will be apparent to one skilled in the art that various changes and modifications can be made therein without departing from the spirit and scope thereof.

What is claimed is:

1. A synthetic lubricating oil comprising an ester derived from (a) a monohydric alcohol having 4 to 18 carbon atoms which has a branched alcohol content of not less than 50 mol % and/or a neopentyl polyol having not more than 30 carbon atoms, (b) a hydroxycarboxylic acid condensate having an average degree of polymerization of not less than 12, and (c) a monocarboxylic acid having 4 to 18 carbon atoms which has a branched carboxylic acid content of not less than 50 mol %, said hydroxycarboxylic acid condensate being selected from the group consisting of:

(i) a condensate of a hydroxycarboxylic acid represented by formula (1):

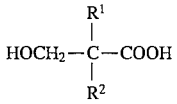

(1)

wherein $R^1$ and $R^2$ each represents a hydrogen atom, a hydroxyl group, a —$CH_2OH$ group, or an alkyl group, provided that when one of $R^1$ and $R^2$ is a hydrogen atom, the other is not a hydrogen atom;

(ii) a condensate of a 2-hydroxycarboxylic acid represented by formula (2):

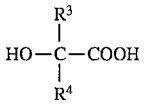

(2)

wherein $R^3$ and $R^4$ each represents a hydrogen atom, a hydroxyl group, or an alkyl group, provided that when one of $R^3$ and $R^4$ is a hydrogen atom, the other is not a hydrogen atom; and (iii) a condensate of a 2-hydroxycarboxylic acid represented by formula (2);

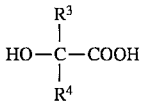

(2)

wherein $R^3$ and $R^4$ each represents a hydrogen atom, a hydroxyl group, or an alkyl group, provided that when one of $R^3$ and $R^4$ is a hydrogen atom, the other is not a hydrogen atom with a hydroxycarboxylic acid represented by formula (1):

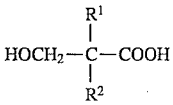

(1)

wherein $R^1$ and $R^2$ each represents a hydrogen atom, a hydroxyl group, a —$CH_2OH$ group, or an alkyl group, provided that when one of $R^1$ and $R^2$ is a hydrogen atom, the other is not a hydrogen atom.

2. A synthetic lubricating oil as claimed in claim 1, wherein the branched alcohol has a methyl group or an ethyl group as a side chain.

3. A synthetic lubricating oil as claimed in claim 2, wherein the branched alcohol has a methyl or ethyl group bonded to the carbon atom at the 2-position in relation to the hydroxyl group.

4. A synthetic lubricating oil as claimed in claim 1, wherein the neopentyl polyol of ingredient (a) is a compound selected from the group consisting of neopentyl glycol, trimethylolethane, trimethylolpropane, ditrimethylolpropane, tritrimethylolpropane, trimethylolbutane, pentaerythritol, dipentaerythritol, and tripentaerythritol.

5. A synthetic lubricating oil as claimed in claim 1, wherein the hydroxycarboxylic acid condensate is a condensate of a dihydroxycarboxylic acid or a condensate of the dihydroxycarboxylic acid with another dihydroxycarboxylic acid represented by formula (1).

6. A synthetic lubricating oil as claimed in claim 5, wherein the dihydroxycarboxylic acid is dimethylolpropionic acid.

7. A synthetic lubricating oil as claimed in claim 1, wherein the 2-hydroxycarboxylic acid is 2-hydroxyisobutanoic acid.

8. A synthetic lubricating oil as claimed in claim 1, wherein the branched monocarboxylic acid has a side chain bonded to the 2-position carbon atom.

9. A synthetic lubricating oil as claimed an claim 1, wherein the branched monocarboxylic acid has a methyl or ethyl group as the side chain.

10. A synthetic lubricating oil as claimed in claim 1, wherein the molar ratio of ingredient (a) to ingredient (b) is from 1:0.2 to 1:20.

11. A working fluid composition for a refrigerating machine which comprises a synthetic lubricating oil and a chlorine-free hydrofluorocarbon in a weight ratio of from 1:99 to 99:1, the synthetic lubricating oil comprising an ester derived from (a) a monohydric alcohol having 4 to 18 carbon atoms which has a branched alcohol content of not less than 50 mol % and/or a neopentyl polyol having not more than 30 carbon atoms, (b) a hydroxycarboxylic acid condensate having an average degree of polymerization of not less than 1.2, and (c) a monocarboxylic acid having 4 to 18 carbon atoms which has a branched carboxylic acid content of not less than 50 mol %, said hydroxycarboxylic acid condensate being, selected from the group consisting of:

(i) a condensate of a hydroxycarboxylic acid represented by formula (1):

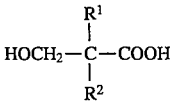

(1)

wherein $R^1$ and $R^2$ each represents a hydrogen atom, a hydroxyl group, a —$CH_2OH$ group, or an alkyl group, provided that when one of $R^1$ and $R^2$ is a hydrogen atom, the other is not a hydrogen atom;

(ii) a condensate of a 2-hydroxycarboxylic acid represented by formula (2):

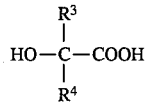

(2)

wherein $R^3$ and $R^4$ each represents a hydrogen atom, a hydroxyl group, or an alkyl group, provided that when one of $R^3$ and $R^4$ is a hydrogen atom, the other is not a hydrogen atom; and (iii) a condensate of a 2-hydroxycarboxylic acid represented by formula (2);

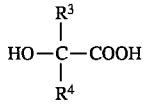

(2)

wherein $R^3$ and $R^4$ each represents a hydrogen atom, a hydroxyl group, or an alkyl group, provided that when one of $R^3$ and $R^4$ is a hydrogen atom, the other is not a hydrogen atom with a hydroxycarboxylic acid represented by formula (1):

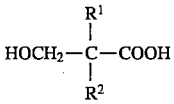

(1)

wherein $R^1$ and $R^2$ each represents a hydrogen atom, a hydroxyl group, a —$CH_2OH$ group, or an alkyl group, provided that when one of $R^1$ and $R^2$ is a hydrogen atom, the other is not a hydrogen atom.

12. A working fluid composition as claimed in claim 11, wherein the weight ratio of the synthetic lubricating oil to the chlorine-free hydrofluorocarbon is from 5:95 to 70:30.

13. A working fluid composition as claimed in claim 11, wherein the chlorine-free hydrofluorocarbon is 1,1,1,2-tetrafluoroethane, difluoromethane, or 1,1,1,2,2-pentafluoroethane.

* * * * *